US005079975A

United States Patent [19]

Spencer, Jr.

[11] Patent Number: 5,079,975

[45] Date of Patent: Jan. 14, 1992

[54] AUTOMATIC CORKSCREW

[76] Inventor: Frank W. Spencer, Jr., Rte. 1, Box 66H, Louisburg, N.C. 27549

[21] Appl. No.: 722,203

[22] Filed: Jun. 27, 1991

[51] Int. Cl.[5] ..... B67B 7/04

[52] U.S. Cl. ..... 81/3.2; 81/3.29; 81/3.45

[58] Field of Search ..... 81/3.2, 3.29, 3.33, 81/3.45, 3.31, 3.32, 3.36

[56] References Cited

U.S. PATENT DOCUMENTS 4,637,283 1/1987 Bertram et al. ..... 81/3.2
4,955,261 9/1990 Chiang ..... 81/3.2

FOREIGN PATENT DOCUMENTS 0129300 12/1984 European Pat. Off. ..... 81/3.29
0129301 12/1984 European Pat. Off. ..... 81/3.39
2608143 6/1988 France ..... 81/3.2
2199813 7/1988 United Kingdom ..... 81/3.2

*Primary Examiner*—Roscoe V. Parker
*Attorney, Agent, or Firm*—Rhodes, Coats & Bennett

[57] ABSTRACT

An automatic corkscrew is capable of both extracting and reinserting a cork from and into a bottle. The corkscrew includes an extraction tube which engages the bottle and forms a cork receiving area. The auger extends through the extraction tube. When rotated in a clockwise direction, the corkscrew first penetrates and then extracts the cork from the bottle. When rotated in the opposite direction, the corkscrew reinserts the cork into the bottle. A gripping means if formed on the extraction tube for gripping the bottle during reinsertion of the cork into the bottle.

12 Claims, 8 Drawing Sheets

AUTOMATIC CORKSCREW

FIELD OF THE INVENTION

The present invention relates generally to corkscrews for removing a cork from a bottle, and more particularly to an automatic cork screw for extracting a cork from a bottle and reinserting the cork into the bottle.

BACKGROUND OF THE INVENTION

Various types of corkscrews are known for removing a cork from a bottle. The conventional corkscrew comprises an auger and a handle. The auger is rotated into the cork and then pulled upwardly to extract the cork from the bottle. Other types of corkscrews employ levers which are used to pull the auger upwardly after rotating the auger into the cork. Most conventional corkscrews require a great deal of effort in order to extract the cork from the bottle.

Automatic corkscrews are known which utilize a motor driven auger to first penetrate and then extract a cork from the bottle. One such device is shown in the patent to Chiang, U.S. Pat. No. 4,955,261. This corkscrew comprises a motor driven auger inside a drawing tube. The drawing tube is inserted over the mouth of the bottle and the auger is rotated into the cork. As the auger rotates, the cork is pulled upwardly into the drawing tube. Once the cork is removed, the motor can be reversed to remove the cork from the drawing tube.

Automatic corkscrews, such as described in the patent to Chiang, greatly minimize the effort needed to extract a cork from the bottle. However, the automatic corkscrews are not capable of reinserting the cork into the bottle. Instead, if a person desires to save a part of a bottle of wine, he or she must manually reinsert the cork into the bottle. Reinsertion of the cork can be difficult because the cork expands once it is removed from the bottle so that it no longer fits easily. When force is applied to the cork to force it into the bottle, the cork tends to expand even further rather than go into the bottle.

Accordingly, a corkscrew apparatus is needed which can more easily and conveniently reinsert the cork into a bottle so that partially used bottles of wine can be saved.

SUMMARY AND OBJECTS OF THE INVENTION

The present invention is a corkscrew apparatus which is capable of both extracting a cork from a bottle and then subsequently reinserting the cork back into the bottle. The corkscrew includes an extraction tube which fits over the mouth of the bottle. An auger extends axially through the extraction tube and is driven by a reversible motor. The auger is rotated into the cork. As the auger advances into the cork, a shoulder formed on the inside of the extraction tube will engage the end of the bottle. Upon engagement between the shoulder of the extraction tube and the end of the bottle, the auger will extract the cork from the bottle into the extraction tube. The extraction tube is sized to maintain the cork in a compressed condition as to keep the cork from expanding once it is removed from a bottle.

To reinsert the cork into the bottle, a collet is attached to the end of the extraction tube for gripping the bottle. A collet is radially compressed by hand to grip the neck of the bottle and the auger is rotated in a counter clockwise direction. The frictional engagement between the cork and extraction tube prevents the cork from rotating with the auger. Accordingly, the cork travels axially down the auger into the bottle opening. Once the cork is reinserted into the bottle, the collet is released. The auger will then rotate out of the cork.

Based on the foregoing, it is a primary object of the present invention to provide an automatic corkscrew for automatically extracting a cork from a bottle of wine.

Another object of the present invention is to provide an automatic corkscrew which is also capable of reinserting the cork back into the bottle.

Another object of the present invention is to provide an automatic corkscrew which is easy to operate and requires little effort to remove a cork from a bottle.

Another object of the present invention is to provide an automatic corkscrew which is capable of extracting and reinserting a cork which is adaptable for use with a broad range of bottle shapes.

Other objects and advantages of the present invention will become apparent and obvious from a study of the following description and the accompanying drawings which are merely illustrative of such invention.

DETAILED DESCRIPTION OF THE INVENTION

Figure 1:
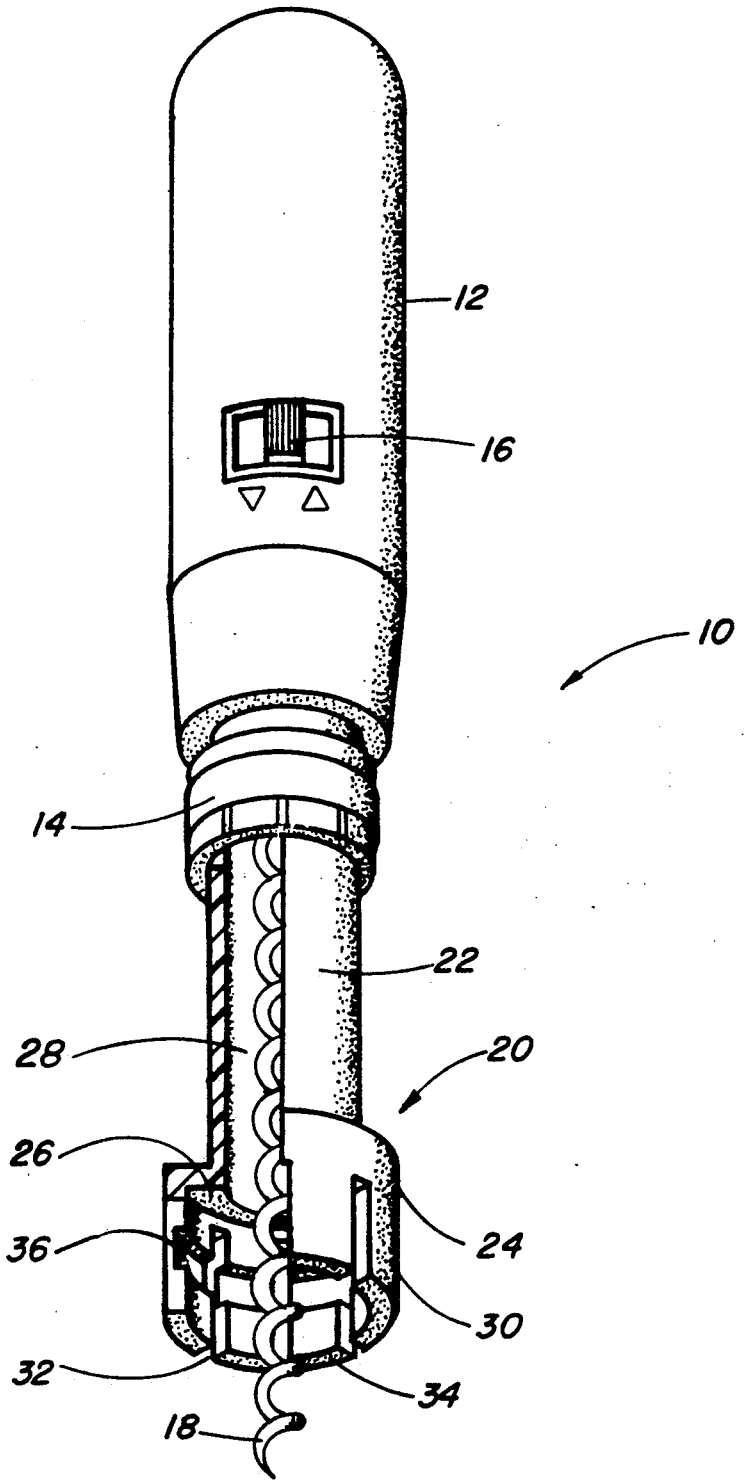
FIG. 1 is a perspective view of the cork extractor of the present invention.

Referring now to the drawings, and particularly to FIG. 1, the automatic corkscrew of the present invention is shown therein and indicated generally by the numeral 10. The automatic corkscrew includes a drive unit 12, an auger or corkscrew 18, and an extraction tube 20. The drive unit 12 includes a threaded collar 14 for mounting the extraction tube 20. The drive unit 12 includes a reversible motor and gear assembly for driving the auger 18. A switch 16 is disposed on the exterior of the drive unit 12 for actuating the motor to rotate the auger in clockwise and counter-clockwise directions. The drive unit 12 is nearly identical in construction to a conventional cordless screwdriver the construction and operation of which are well known to those skilled in the art.

The extraction tube 20 is mounted to the collar 14 of the drive unit 12 by threadably engaging an upper end 22 of the extraction tube 20 in the collar 14 of the drive unit 12. The auger 18 extends axially through the extraction tube 20 beyond the end of the extraction tube 20. The lower end 24 of the extraction tube 20 is enlarged so as to fit over the neck of a bottle. A shoulder 26 is formed inside the lower end 24 of the extraction tube 20 to engage the end of the bottle. The opening 28 of the extraction tube is approximately the same size as the bottle opening from which the cork is being removed. Thus, when the cork is extracted from the bottle 42 into the extraction tube 20 as will be hereinafter described, the cork does not have an opportunity to radially expand.

The extraction tube 20 includes means for gripping the bottle 42 during reinsertion of the cork 40. The bottle gripping means may comprise a collet 30 formed at the lower end 24 of the extraction tube 20. The collet 30 includes a plurality of resilient collet segments 34 separated by longitudinally extending slots 32. The collet segments 34 can be radially compressed by hand to firmly grip the bottle 42. To further enhance the gripping of the bottle, an annular groove 36 can be formed on the inside of the collet segments 34 to receive the lip 44 of the bottle 42.

Figure 2A:
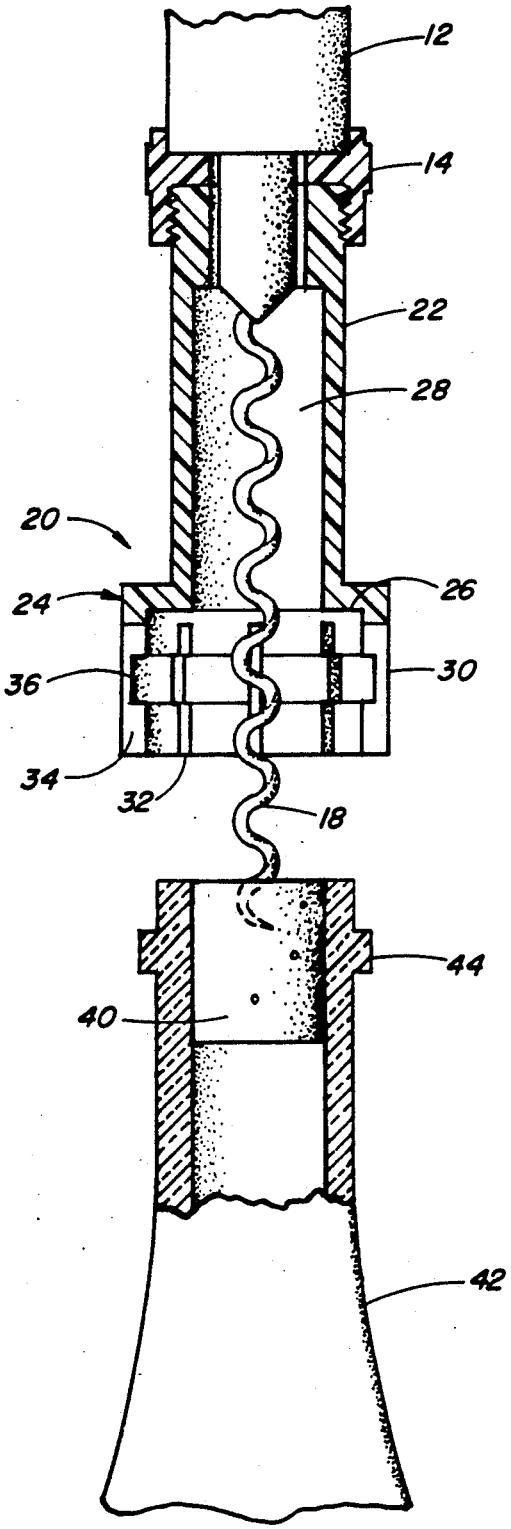
FIGS. 2A–2C are section views illustrating how the cork extractor is used to remove a cork from a bottle.
Figure 2B:
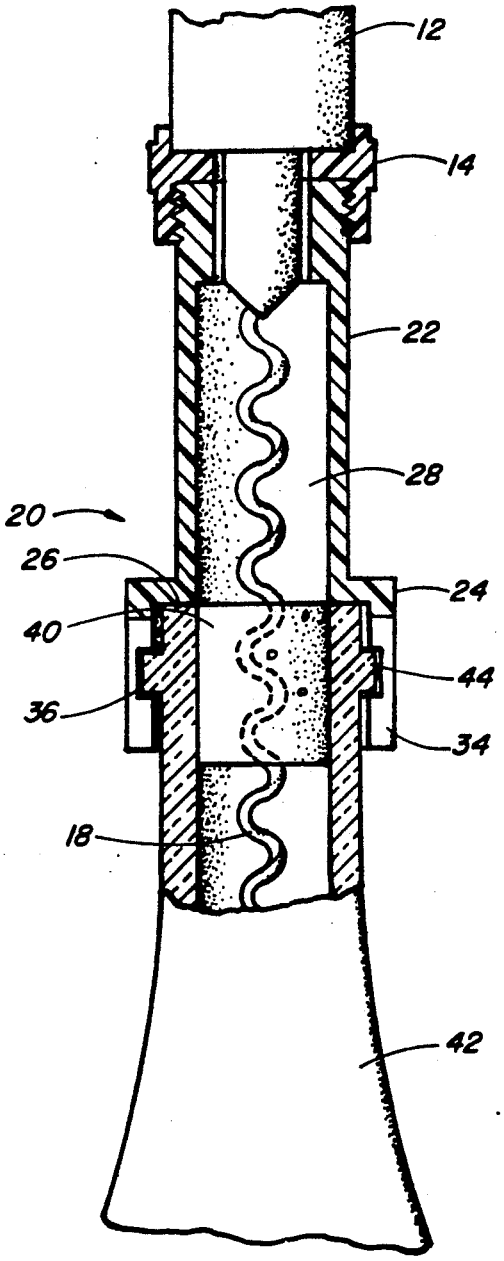
Figure 2C:
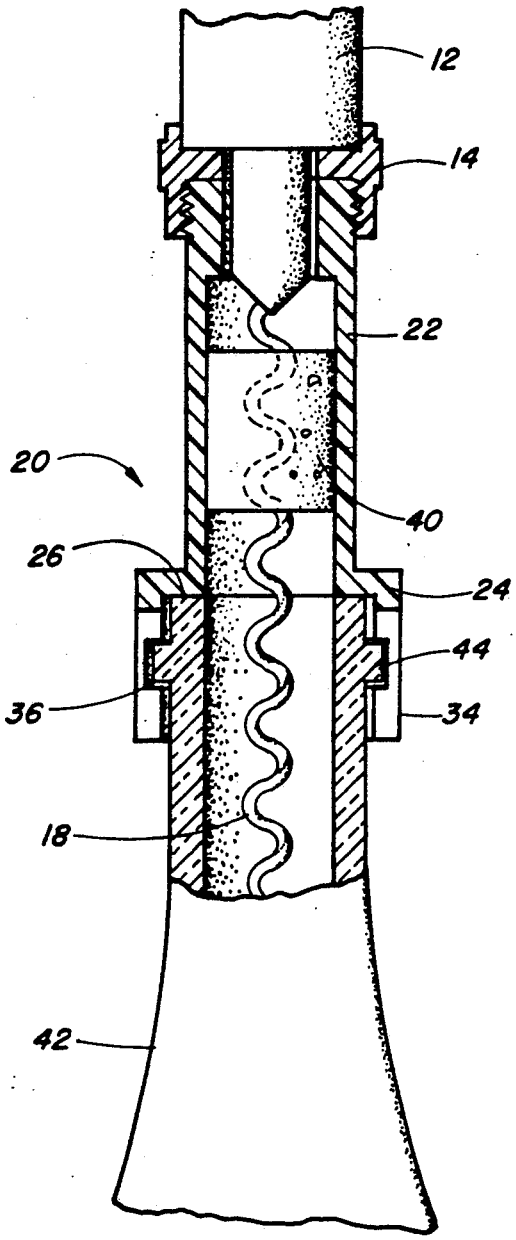

Referring now to FIGS. 2A–2C, the operation of the automatic corkscrew to remove a cork 40 from a bottle is shown. The tip of the auger 18 is placed at approximately the center of a cork 40. The drive unit 12 is actuated to rotate the auger 18 in a clockwise direction. The auger 18 will rotate into the cork as seen in FIG. 2A. As the auger penetrates the cork, the extraction tube 20 is lowered into engagement with the bottle 42 as shown in FIG. 2B. Once the shoulder 26 engages the end of the bottle, the rotation of the auger 18 will cause the cork 40 to be pulled upwardly into the opening 28 of the extraction tube as seen in FIG. 2C. The friction between the cork 40 and the extraction tube 28 will prevent the cork from rotating within the extraction tube 20.

Figure 3A:
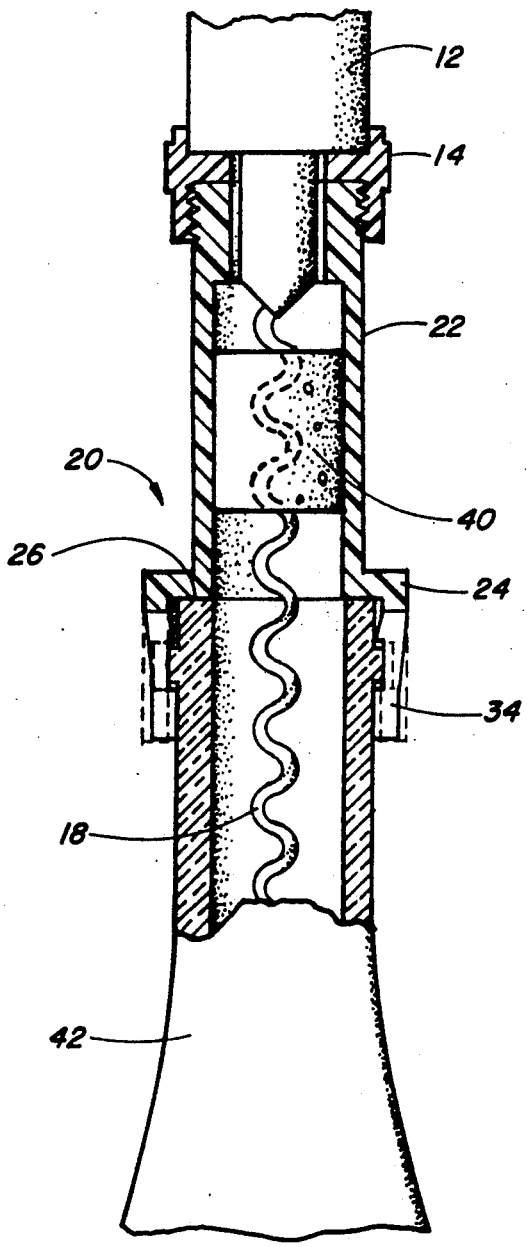
FIGS. 3A–3C are section views illustrating how the cork extractor is used to reinsert the cork into the bottle.
Figure 3B:
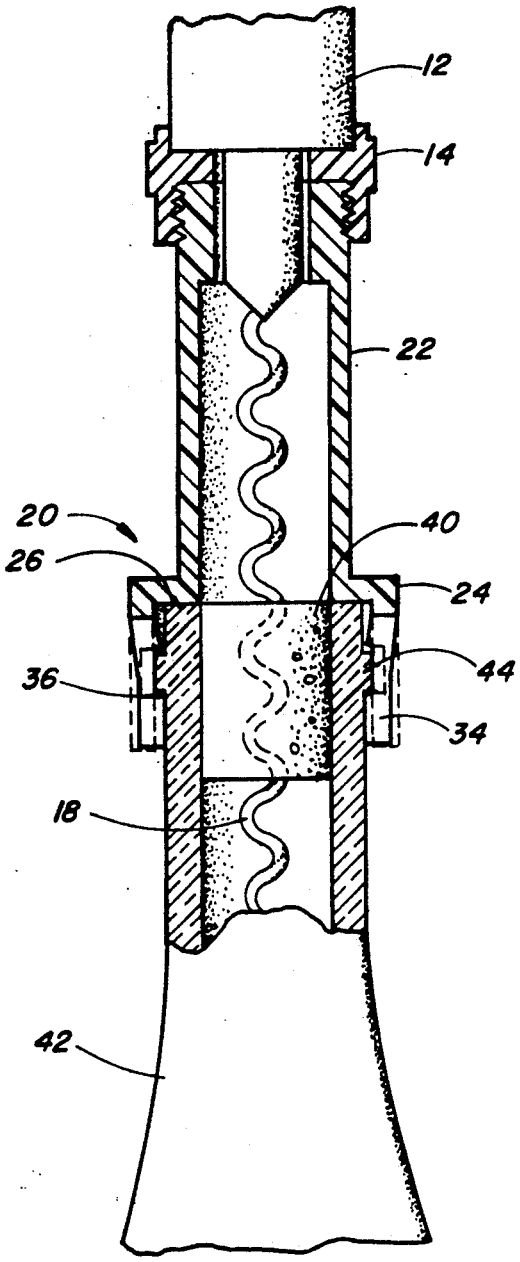
Figure 3C:
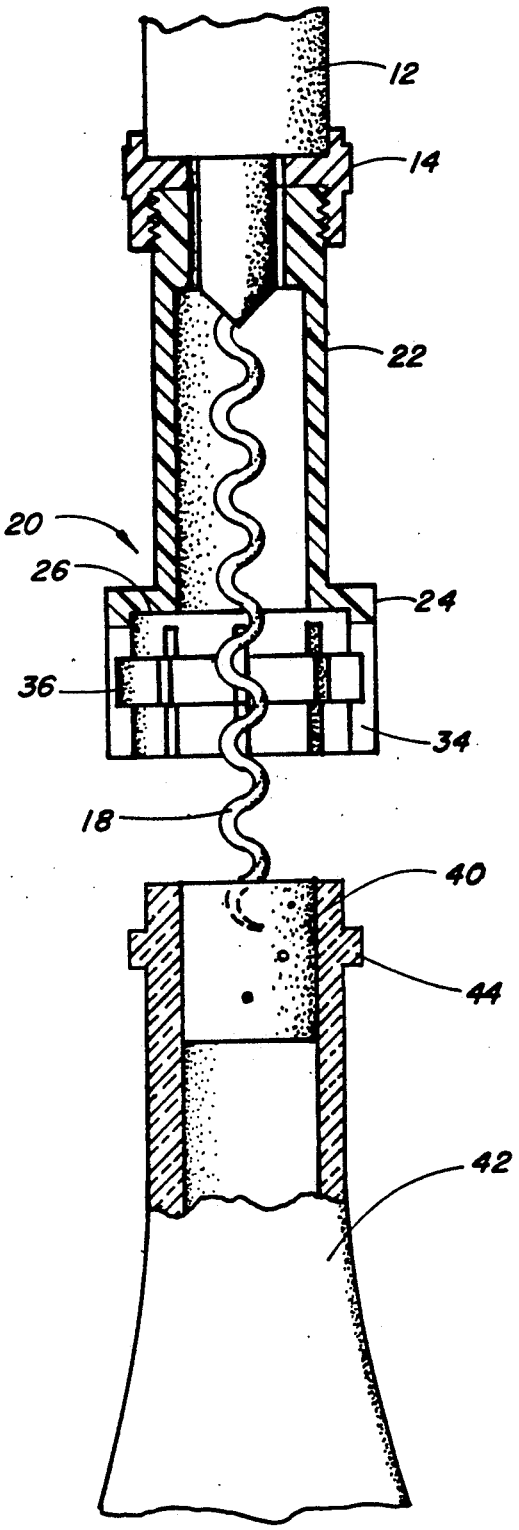

When it is desired to reinsert the cork 40 back into the bottle 42, the lower end 24 of the extraction tube is lowered over the end of the bottle until the shoulder 26 engages the end of the bottle 42. The resilient collet segments 34 are then radially compressed by hand to firmly grip the bottle neck as shown in FIG. 3A. The annular groove 36 cooperates with the lip 44 of the bottle 42 to prevent the extraction tube 20 from being pushed upwardly out of engagement with the bottle. The auger 18 is rotated in a counter-clockwise direction. As the auger 18 rotates, the cork 40 travels axially down the auger 18 into the bottle opening as shown in FIG. 3B. Once the cork 40 is fully inserted into the bottle 42, the collet segments 34 are released while the auger 18 continues to rotate. Upon releasing the collet segments 34, the auger 18 will rotate out of the cork 40 as seen in FIG. 3C.

Using the present invention, the cork 40 can be removed and reinserted many times without destruction of the cork 40. Further, the entire extraction tube 20 can be removed from the drive unit 12 when needed for cleaning.

Figure 4:
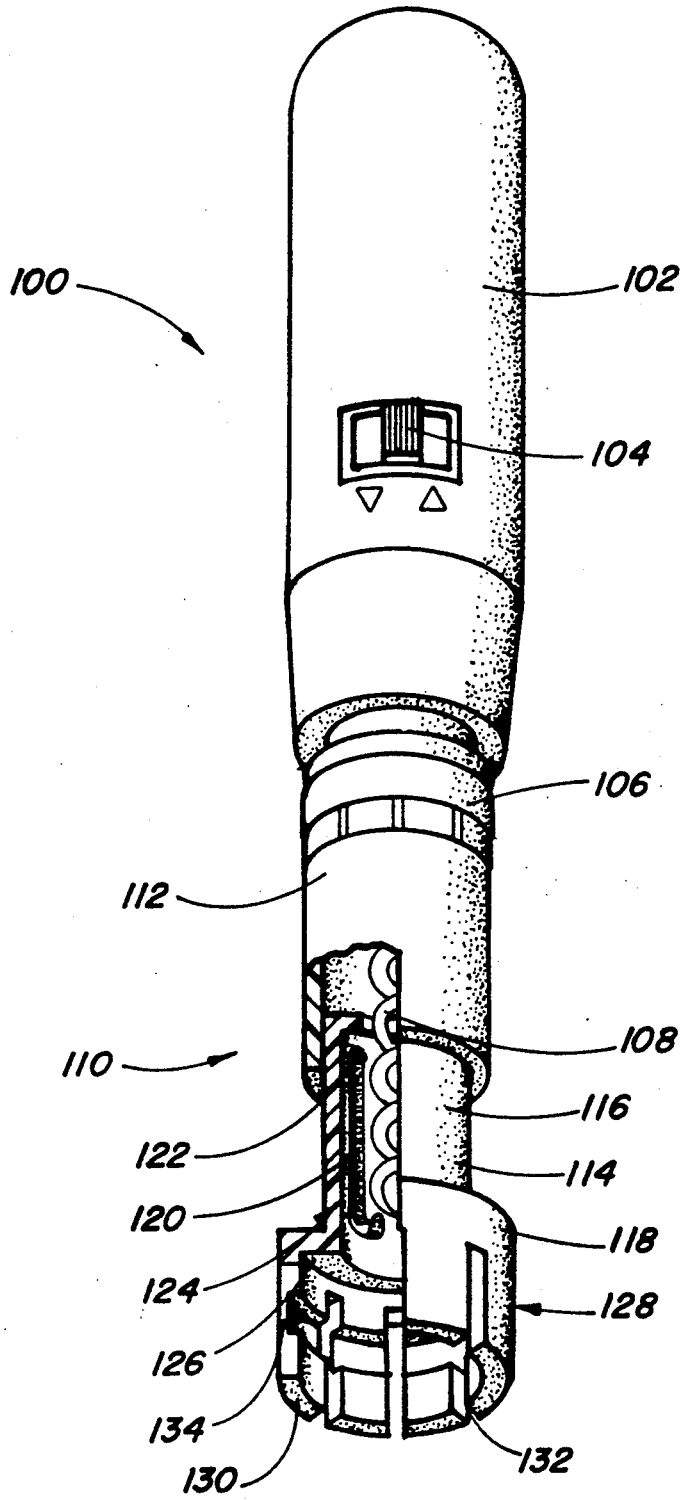
FIG. 4 is a perspective view of a second embodiment of the cork extractor.

Referring now to FIG. 4, a second embodiment of the corkscrew is shown and indicated generally by the numeral 100. The second embodiment includes a drive unit 102 and an auger 108. The drive unit 102 includes a switch 104 as previously described for actuating the drive unit 102 to rotate the auger 108 in both clockwise and counter-clockwise directions. A collar 106 is fixedly secured to the drive unit 102 for mounting a two-piece cork extracting assembly 110.

The cork extracting assembly 110 includes a guide tube 112 which is threadably engaged in the collar 106 of the drive unit 102. An extraction tube 114 having an upper portion 116 and a lower portion 118 is slidably mounted in the guide tube 112. The upper portion 116 of the extraction tube 114 has an outside diameter which is slightly smaller than the inside diameter of the guide tube 112 so that it will freely slide in the guide tube 112. A longitudinally extending L-shaped slot 120 is formed in the upper portion 116 of the extraction tube 114 which receives a peg 122 fixed to the guide tube 112. When the extraction tube 114 is in the fully extended position, the peg 122 engages the upper end of the slot 120 to prevent removal of the extraction tube 114 from the guide tube 112. In a fully compressed condition, the peg 122 is aligned with the short leg of the L-shaped slot 120 so that the extraction tube 114 can be rotated relative to the guide tube 112 to lock the extraction tube 114 in place to prevent it from extending during reinsertion of the cork as will be hereinafter described.

The upper portion of the extraction tube defines a cork receiving area 124 for receiving the cork once it is removed from the bottle. The lower portion 118 of the extraction tube 114, as in the first embodiment, is larger than the upper portion 116 and fits over the end of a bottle. A shoulder 126 is formed inside the lower portion 118 of the extraction tube 114 to engage the end of the bottle. The lower end of the extraction tube 114 also includes means for gripping the bottle during reinsertion of the cork into the bottle. The bottle gripping means comprises a collet 128 including a plurality of resilient collet segments 130 separated by longitudinally extending slots 132. The collet segments 130 can be radially compressed by hand to firmly grip the bottle. An annular groove 134 may be formed on the inside of the collet segments 130 to receive the lip 44 of the bottle to facilitate the gripping of the bottle 42.

Figure 5A:
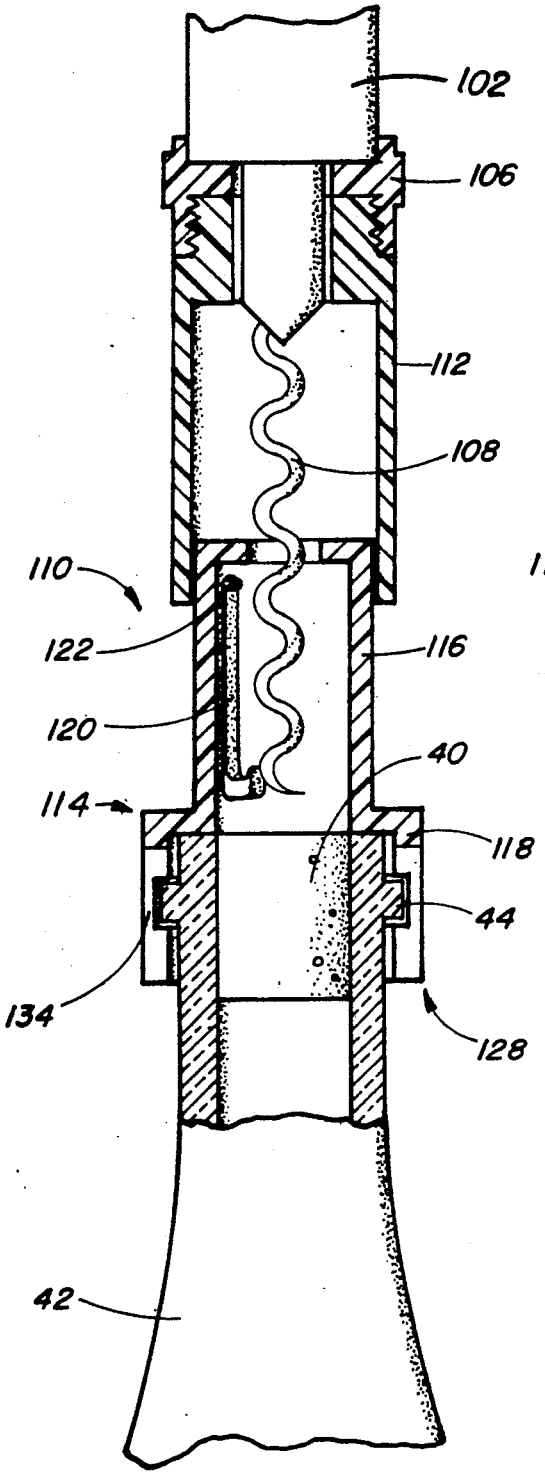
FIGS. 5A–5C are section views of the second embodiment illustrating how the cork extractor is used to remove a cork from a bottle.
Figure 5B:
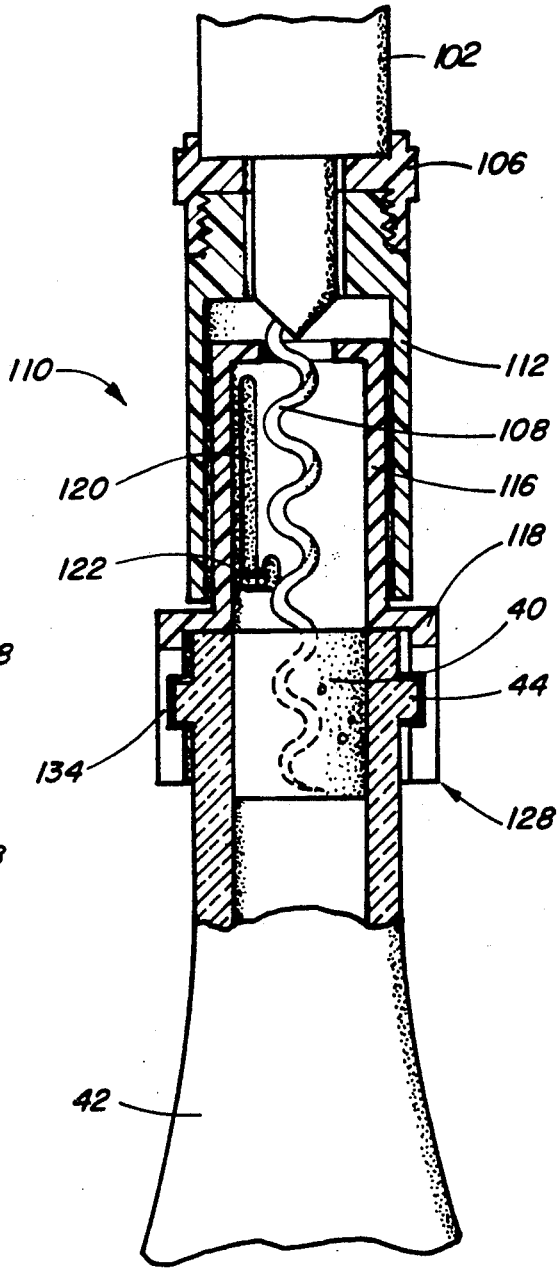
Figure 5C:
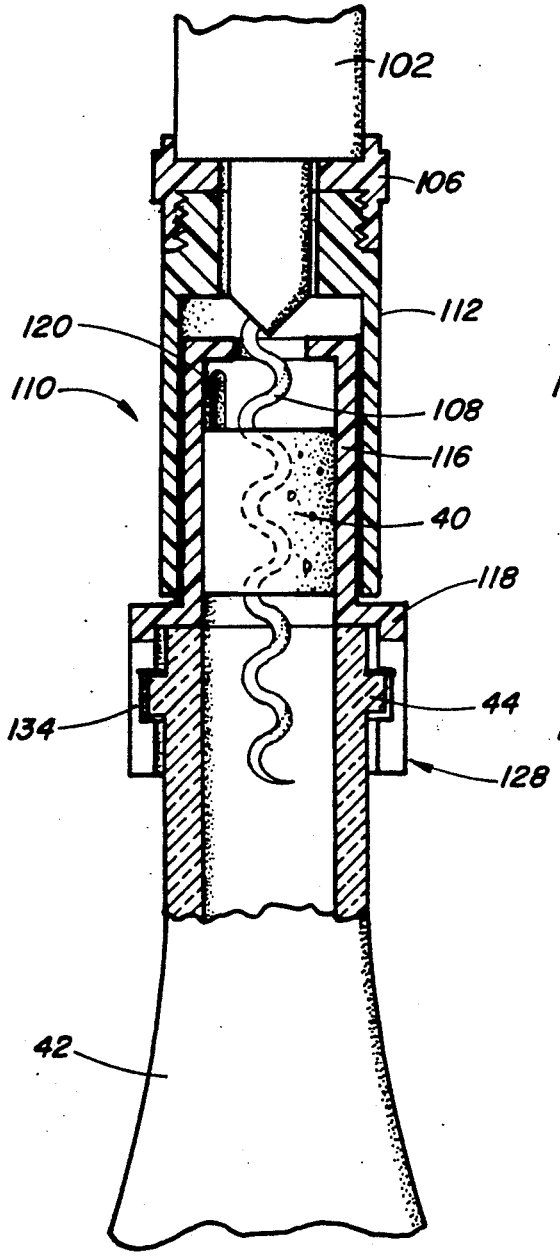

Referring now to FIGS. 5A–5C, the operation of the second embodiment is illustrated. The extraction tube is initially in an extended position as shown in FIG. 5A. The lower portion 118 of the extraction tube 114 is placed over the end of the bottle so that the lip 44 of the bottle is received in the annular groove 134. The auger 108 is then rotated in a clockwise direction while pushing downwardly on the drive unit 102. As the drive unit 102 is lowered, the guide tube 112 slides down over the upper portion 116 of the extraction tube 114 so that the auger 108 engages the center of the cork. Once the auger 108 contacts the cork 40, the auger 108 will penetrate the cork while pulling the entire drive unit 102 downwardly until the end of the guide tube 112 engages the enlarged lower portion 118 of the extraction tube 114 as seen in FIG. 5B. The rotation of the auger will then draw the cork up into the cork-receiving area 124 of the extraction tube 114 as shown in FIG. 5C. After extracting the cork 40 from the bottle, the extraction tube 114 is rotated relative to the guide tube 112 in order to lock the extraction tube 114 in a retracted position.

Figure 6A:
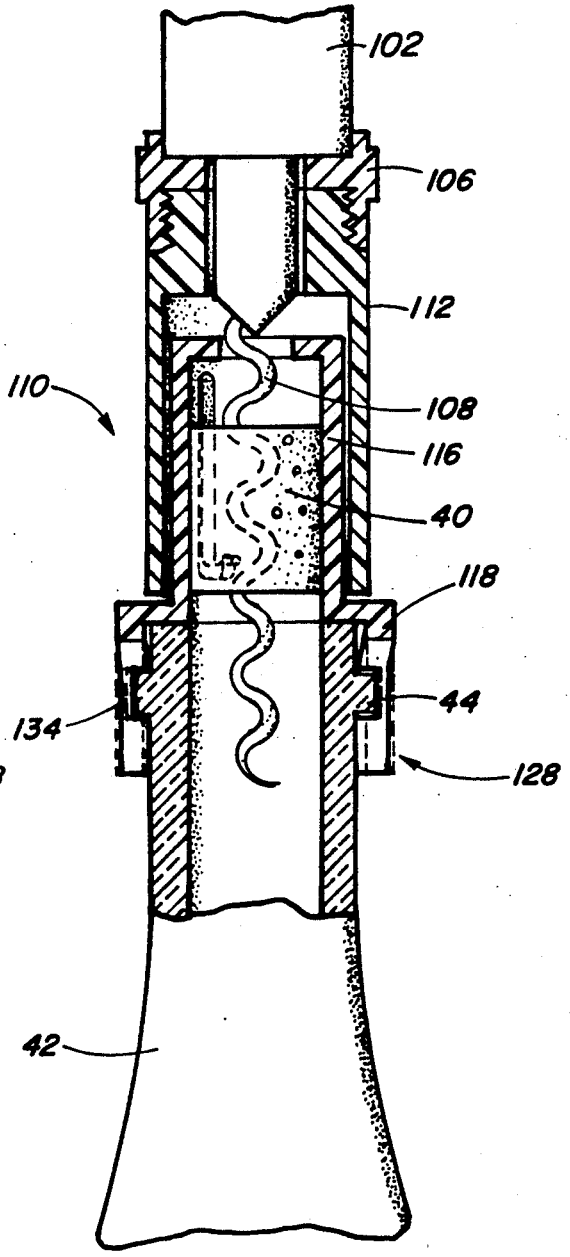
FIGS. 6A–6C are section views of the second embodiment illustrating how the cork is reinserted into the bottle.
Figure 6C:
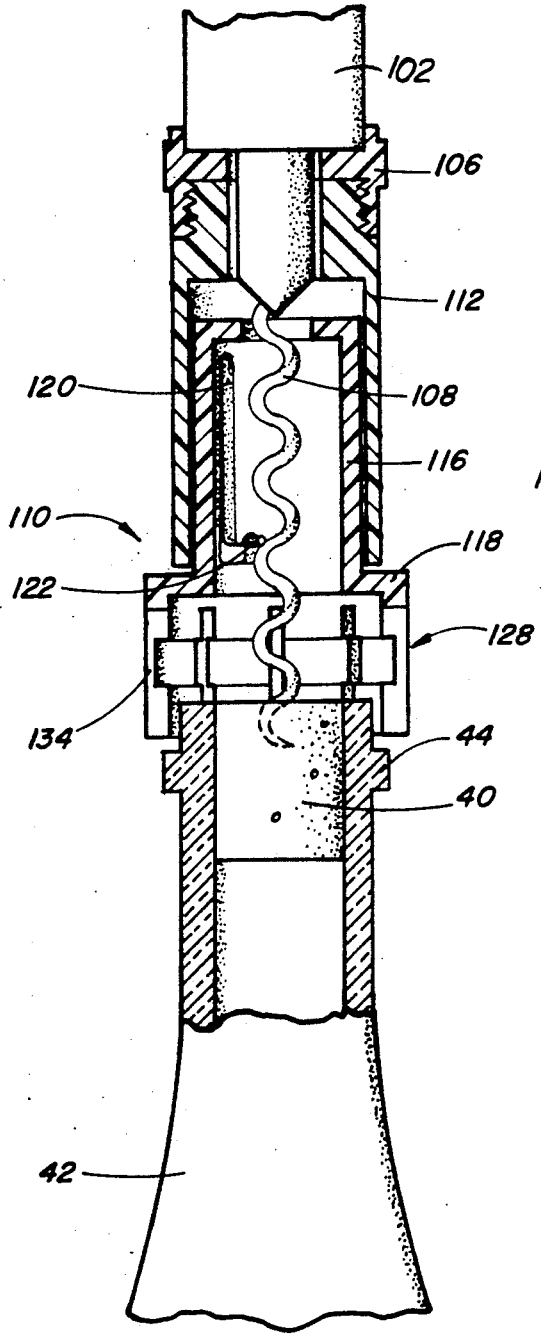
Figure 6B:
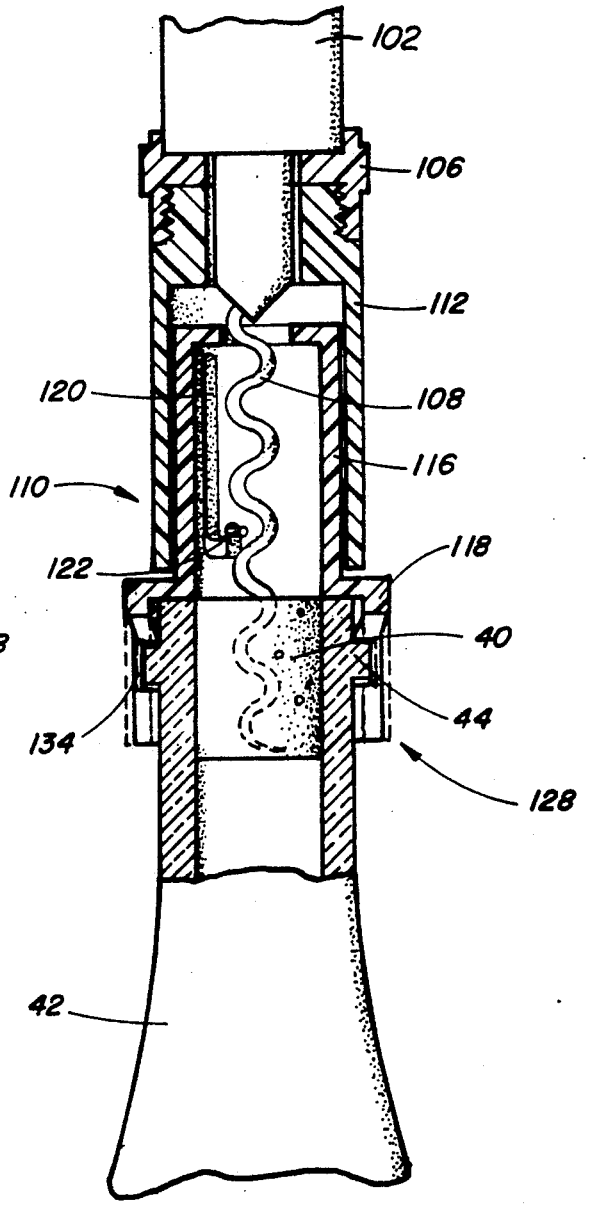

To reinsert the cork 40 into the bottle, the lower portion 118 of the extraction tube 114 is placed over the end of the bottle 42 so that the lip 44 of the bottle 42 is received in the annular groove 134. The collet segments 130 are radially compressed by hand to firmly grip the bottle as shown in FIG. 6A. The auger 108 is rotated in a counter-clockwise direction so that the cork 40 travels axially down the auger 108 into the bottle 42 as shown in FIG. 6B. Once the cork 40 is fully inserted into the bottle 42, the collet segments 130 are released. The auger 108 will then rotate out of the cork 40 as shown in FIG. 6C, while the drive unit 102 is being raised.

In some circumstances, it may be desirable to use the automatic corkscrew to remove corks from more than one bottle. The cork can be easily removed from the extraction tube by rotating the auger in the counterclockwise direction. However, the cork will radially expand when it is removed from the extraction tube making it difficult to later reinsert the cork into the bottle. The second embodiment of the invention could include multiple, removable extraction tubes. After removing the cork from the bottle, the auger can be reversed to allow the auger to rotate out of the cork while the cork remains inside the extraction tube. Later, the extraction tube can be remounted by inserting the extraction tube into the guide tube which allows the auger to rotate into the cork. After remounting the extraction tube, the corkscrew can be used in the same manner as previously described to reinsert the cork into the bottle.

Based on the foregoing, it is apparent that the automatic corkscrew of the present invention provides an easy and convenient method for first removing a cork from a bottle and then reinserting the cork into the bottle. The present invention does very little damage to the cork so that the cork can be removed and reinserted many times.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. An electric corkscrew for removing and reinserting a cork from a bottle, comprising:

(a) a reversible drive unit;

(b) an auger driven by the drive unit;

(c) a cylindrical housing structure surrounding the auger and including:

(1) a cork extraction sleeve extending around the auger and having a terminal end, wherein the inside diameter of the sleeve is approximately equal to the inside diameter of the bottle;

(2) a bottle stop formed at the terminal end of the cork extracting sleeve for abutting against the end of the bottle; and (3) bottle gripping means projecting beyond the terminal end of the cork extracting sleeve for engaging the bottle and holding the bottle stationary with respect to the cork extraction sleeve;

(d) wherein the auger is rotated in a first direction to initially penetrate the cork and pull the extraction tube downwardly into engagement with the bottle, whereafter the auger pulls the cork from the bottle into the cork extraction sleeve which confines the cork in a compressed condition and prevents the cork from radially expanding; and (e) wherein the auger is rotated in a second direction while the bottle gripping collar grips the bottle to reinsert the cork into the bottle.

2. The corkscrew according to claim 1 wherein said bottle gripping means comprises a collet integrally formed at one end of the extraction tube, said collet including a plurality of slots defining a plurality of resilient collet segments.

3. The corkscrew according to claim 2 wherein said collet includes an annular groove formed on the inside of said collet for receiving a lip formed on the bottle.

4. The corkscrew according to claim 1 wherein the extraction tube is removably mounted to the housing.

5. The corkscrew according to claim 1 further including a guide tube for slidably mounting the extraction tube so as to be movable between and extended position and a retracted position.

6. The corkscrew according to claim 5 wherein the extraction tube and the guide tube slide axially relative to one another during removal of the cork from the bottle.

7. The corkscrew according to claim 6 further including a locking means for locking the guide tube and the extraction tube in a retracted position during reinsertion of the cork into the bottle.

8. An electric corkscrew for removing a cork from a bottle and then reinserting the cork into the bottle comprising:

(a) a reversible drive unit;

(b) a guide tube fixedly secured to the drive unit;

(c) a cork extraction tube mounted on the guide tube so that the extraction tube and guide tube slide axially, with respect to one another, between an extended position and a retracted position, said cork extraction tube including:

(1) a sleeve defining a cork-receiving area for receiving the cork as it is extracted from the bottle;

(2) bottle-engaging means formed on a terminal end of the sleeve for engaging the bottle during extraction of the cork from the bottle;

(3) stop means to limit the relative axial movement between the extraction tube and guide tube when they assume a retracted position; and (d) bottle gripping means formed on extraction tube for gripping the bottle;

(e) an auger driven by said drive means and extending through said guide tube and extraction tube;

(f) wherein the auger is rotated in a first direction to first penetrate the cork while the extraction tube and the guide tube extracts the cork from the bottle; and (g) wherein the auger is rotated in a second direction while the bottle gripping means grips the bottle to reinsert the cork into the bottle.

9. The automatic corkscrew according to claim 8 further including means for locking the extraction tube and guide tube in a retracted position during reinsertion of the cork into the bottle.

10. The automatic corkscrew according to claim 9 wherein the means for locking the guide tube and the extraction tube in a retracted position comprises a generally L-shaped slot formed in either the guide tube or the extraction tube, and a peg extending from the other of the two parts into the L-shaped slot.

11. The corkscrew according to claim 8 wherein the bottle gripping means comprises a collet integrally formed at one end of the extraction tube, said collet including a plurality of slots defining a plurality of resilient collet segments which are radially compressible by hand to grip the bottle.

12. The corkscrew according to claim 11 wherein said collet includes an annular groove formed on the inside of said collet for receiving a lip formed on the bottle.

* * * * *